United States Patent [19]

Masuda et al.

[11] Patent Number: 4,857,949

[45] Date of Patent: Aug. 15, 1989

[54] DEVICE FOR VENTING FUMES GIVEN OFF BY AUTOMATIC DEVELOPING EQUIPMENT

[75] Inventors: Yoshihiro Masuda; Takashi Yagi; Akira Murata, all of Kyoto, Japan

[73] Assignee: Dainippon Screen Mfg. Co., Ltd., Japan

[21] Appl. No.: 218,835

[22] Filed: Jul. 13, 1988

[30] Foreign Application Priority Data

Jul. 13, 1987 [JP] Japan ..... 62-106376

[51] Int. Cl.[4] ..... G03D 3/00

[52] U.S. Cl. ..... 354/322; 354/321

[58] Field of Search ..... 354/309, 320, 321, 322; 355/27, 30

[56] References Cited

U.S. PATENT DOCUMENTS 4,673,273 6/1987 Yoshimi ..... 354/322

4,695,146 9/1987 Fuller ..... 354/309

FOREIGN PATENT DOCUMENTS 59-26356 7/1984 Japan .

61-151652 7/1985 Japan .

61-42542 3/1986 Japan .

62-16951 1/1987 Japan .

*Primary Examiner*—A. A. Mathews

*Attorney, Agent, or Firm*—Ostrolenk,Faber,Gerb & Soffen

[57] ABSTRACT

A device for venting fumes given off by an automatic developing system which includes a developing tank, a fixing tank and a cleansing tank. The device includes a cover for airtight placement over the system and a suction case provided on the inner surface of the cover. The suction case has pores directed toward the developing tank and the fixing tank. Fumes in the system are collected, under suction, through the pores.

8 Claims, 6 Drawing Sheets

DEVICE FOR VENTING FUMES GIVEN OFF BY AUTOMATIC DEVELOPING EQUIPMENT

BACKGROUND OF THE INVENTION

1. Field of the Invention

The present invention relates generally to a photographic developing system in which developing, fixing and washing are automatically conducted in series, and more particularly to a device for venting fumes such as gases, smoke and vapor, which are unavoidably given off during developing and fixing.

2. Description of the Prior Art

In known automatic developing systems, working solutions, such as developer and a fixing solution, are heated to as high a temperature as 30° to 40° C. The solutions are held in separate tanks. The heated solutions emit fumes. The fumes corrode mechanical components of the system.

In addition, the fumes tend to stick in droplets to the inner sides of the tanks' covering the drops grow and eventually fall into the tanks. When droplets of developer fall into a fixing tank, no serious problem arises. However, if the fixing solution (in droplet form) mixes with developer, the developer is fatally degenerated so that development becomes difficult. If droplets of developer fall onto a photosensitive material travelling along the crossover track, uneven treatment is likely to occur. Thus, removal of fumes is essential to development.

In line with the demand in the industry, a developing system has been proposed which includes a device for letting out fumes. The system is disclosed in Japanese Utility Model Publication (examined) No. 59-26356. This prior art system includes an exhaust pipe provided in an upper section thereof. The exhaust pipe is connected to a blower so as to vent fumes from the system.

There is another developing system known in the art, which, instead of an exhaust pipe, includes outlets provided in lids or side walls thereof to let out fumes.

There is a further proposal disclosed in Japanese Patent Publication (unexamined) No. 61-151652. To explain the background of the present invention, this prior art developing system will be described in detail with reference to FIG. 8:

A film is passed through a developing tank 2, a fixing tank 3, a cleansing tank 4 and a dryer 5 all of which are provided in operational order in the system 1. The system 1 is provided with a tray-shaped gas collector 6 in its ceiling. The collector 6 includes a short pipe 7 connected to a discharge duct 8. The short pipe 7 is closed by a cap 7' so as to prevent treating solution and cleansing water from entering the exhaust outlet 7. The fumes are discharged through the duct 8.

The common disadvantage of the known devices mentioned above is that the gas collecting opening(s) whether in the form of a pipe or a bore, is/are located at only one or two locations within the entire system. This causes the fumes which are far from the opening to be left unevacuated from an system. In large-scale developing systems a larger quantity of the fumes are likely to be left unevacuated because of such uneven distribution of suction.

To solve this problem a large blower is employed to increase the suction power. The provision of a large blower requires a large accommodation space, increases the cost, and causes a noise problem.

In the system of FIG. 8, the film is normally fed from a feed section 10 along a route (indicated by the dotted lines) but when necessary, the film is supplied into the system midways along the regular route. For example, when unsensitized film capable of being handled in bright rooms are supplied, there is no need to pass the film through the darkroom; If the feed section 10 is a dark room and the other sections are bright, the film need not be introduced through the dark room but can be supplied through the bright rooms into the developing tank 2. This advantageously speeds up the developing process. Likewise, a special slit may be produced in an upper section of the drying tank 5 to dry a film already cleansed at another place. However, these specially made slits allow the fumes confined in system to escape therefrom. As mentioned above, leaked fumes corrode the mechanical components of system and cause a pollution problem. When the system has a built-in process camera and a printer, the high-precision mechanical components of these instruments are spoiled by leaked fumes.

OBJECTS AND SUMMARY OF THE INVENTION

The present invention aims at solving the problems pointed out with respect to the known devices discussed above, and has for its object to provide an improved device for venting fumes entirely from a system.

Other objects and advantages of the present invention will become more apparent from the following detailed description, when taken in conjunction with the accompanying drawings which show, for the purpose of illustration only, one embodiment in accordance with the present invention.

According to the present invention, there is provided a device for venting fumes giving off in an automatic developing system The device includes a covering means for airtight placement over the system, and a suction case provided on the inner surface of the covering means. The suction case has pores directed toward the developing tank and the fixing tank the device further includes a sucking means for collecting the fumes by suction through the pores of the suction case.

DETAILED DESCRIPTION OF THE INVENTION

Figure 1:
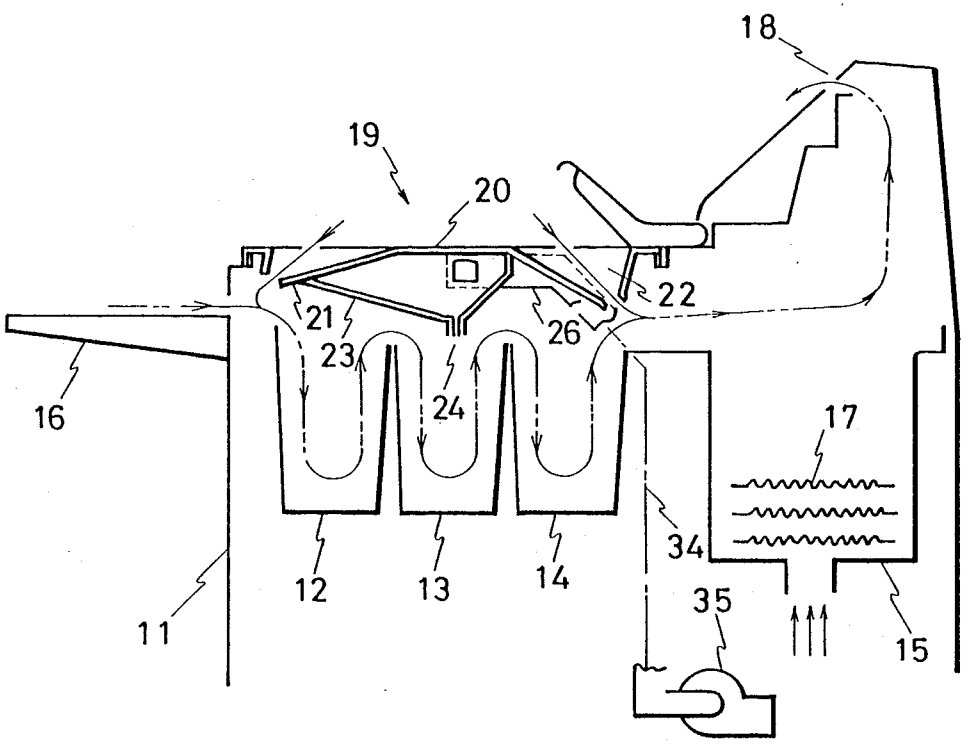
FIG. 1 is a schematic side view showing an automatic developing system including a device according to the present invention.
Figure 2:
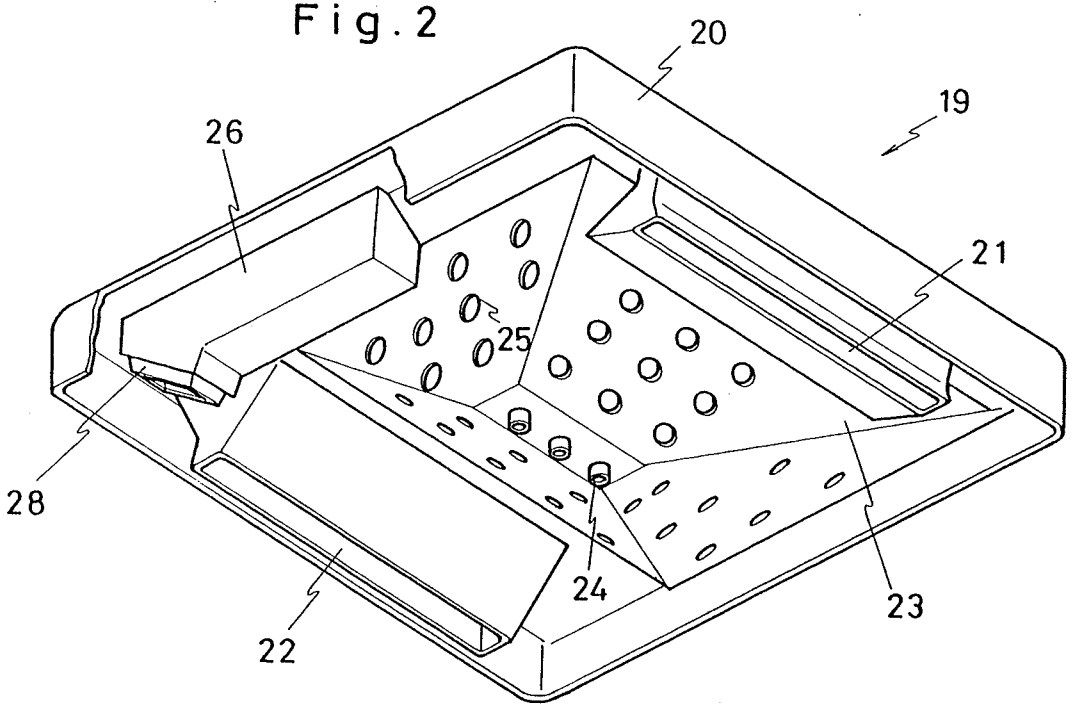
FIG. 2 is a perspective bottom view showing the device of FIG. 1.

The illustrated developing system has a main body 11. The main body 11 accommodates a developing tank 12, a fixing tank 13, a cleansing tank 14 and a dryer 15. A film is introduced into the main body 11 through a feed section 16, and within the main body 11, the film is fed along a route indicated by dotted lines by a conveyor (not shown). The developing tank 12 holds developer, the fixing tank 13 holds fixing solution, and the cleansing tank 14 holds water. The dryer 15 includes heating elements 17, from which heated air is blown by a blower against the film passing overhead. The dried film is discharged through an exit 18. The open top end of the main body 11 is covered with a device 19 according to an embodiment of the present invention. The device 19 will be hereinafter described in detail.

The device 19 includes a tray-shaped body 20, which covers the developing tank 12, the fixing tank 13 and the cleansing tank 14 in such a manner as to shut them against light. The tray-shaped body 20 is provided with two extra film passageways 21 and 22 at an upstream section and at a downstream section with respect to the travelling route of the film. Hereinafter, the passageways 21 and 22 will be referred to as "upstream passageway" and "downstream passageway", respectively.

The device 19 is placed over the main body 11 such that the upstream passageway 21 is situated above an upstream side of the developing tank 12, and the downstream passageway 22 is situated above the dryer 15; preferably, above its upstream side. The tray-shaped body 20 is provided with a suction case 23 having pores 25 formed therein. The suction case 23 is shaped like a pyramid with at least one drain bore 24 (in the illustrated embodiment three drain bores) in its top. The device 19 is arranged so that the drain bores 24 are situated above the fixing tank 13.

The tray-shaped body 20 is additionally provided with an outlet duct 26 having a polygonal crosssection, which includes an outlet port 27 and a mouthpiece 28 for connection to an exhaust pathway located in the main body 11. The outlet duct 26 is connected to the exhaust pathway of the main body 11.

Figure 3:
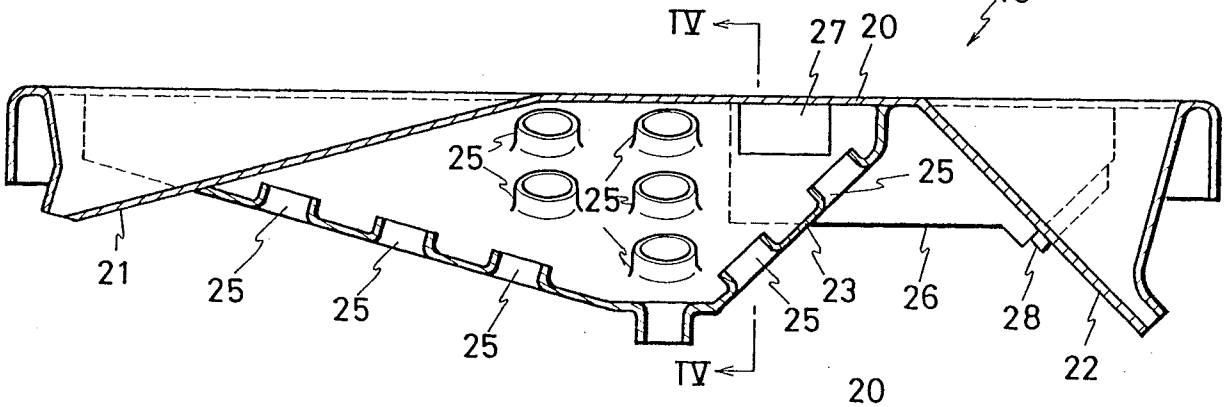
FIG. 3 is a cross-section through the device of FIG. 1.
Figure 4:
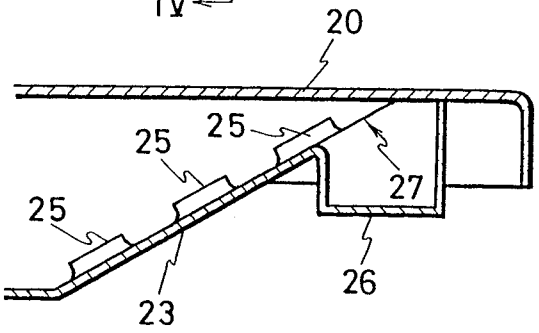
FIG. 4 is a fragmentary cross-sectional view taken along the line N—N in FIG. 3.
Figure 5:
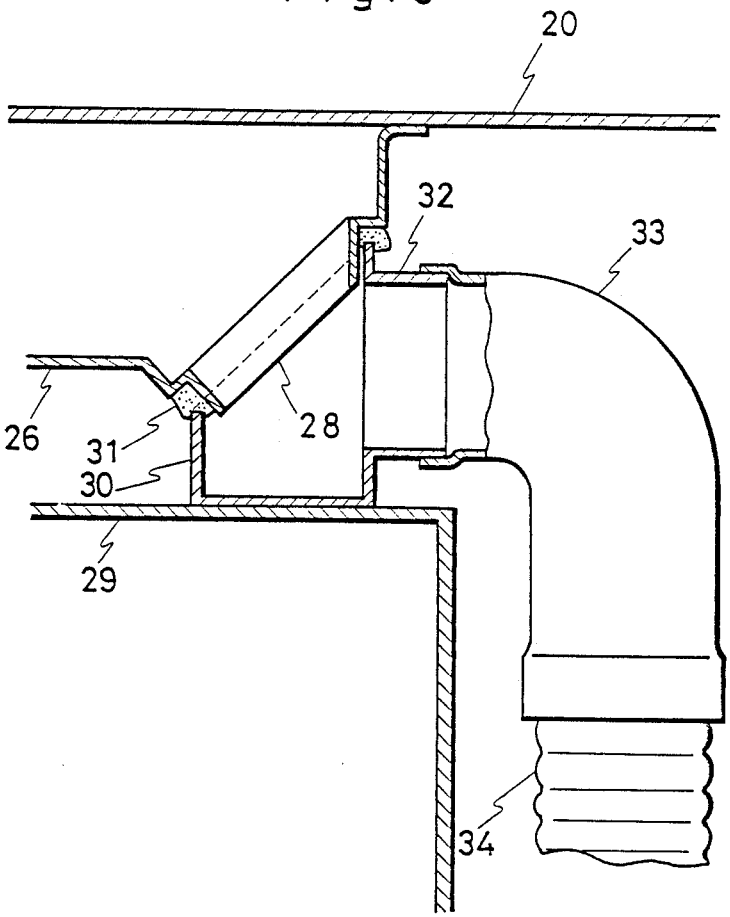
FIG. 5 is a cross-sectional view showing a joint portion to an exhaust pipe.

As best shown in FIG. 3, the mouthpiece 28 is formed such that its upper end wall is oblique with respect to the open end of the outlet duct 26, whereas its lower end wall is vertical thereto. The main body 11 is provided with a bracket 29 for supporting the outlet duct 26 through a supporter 30 directly joined to the mouthpiece 28. The seal between the mouthpiece 28 and the supporter 30 is secured by packings 31. The supporter 30 includes an outlet 32 connected to an exhaust hose 34 through an elbow 33, the exhaust hose 34 being connected to a blower 35 (FIG. 1).

By joined the mouthpiece 28 to the supporter 30, the suction case 23 is connected to the blower 35 through the outlet duct 26, the outlet 32, the elbow 33 and the exhaust hose 34.

When the blower 35 is driven, fumes in the main body 11 are drawn into the suction case 23 through the pores 25. Since the suction case 23 is situated above the developing tank 12 and the fixing tank 13 where highly concentrated fumes are given off, the fumes are safely drawn into the case 23 through the pores 25. The fumes tend to gather on the inner surface of the suction case 23, and liquefy into droplets, which are directed to fall into the fixing tank 13 through the drain bores 24. Thus, the developer in the developing tank 12 is kept safe from contamination by the droplets of fixing solution. As shown in FIG. 3, each pore 25 is provided with a flange along its periphery to prevent droplets from falling therethrough. At night, when the blower 35 is not in operation, droplets forms on the outer surface of the suction case 23. However, the droplets are safely guided along the pyramid sides of the suction case 23 to fall into the fixing tank 13.

Figure 6:
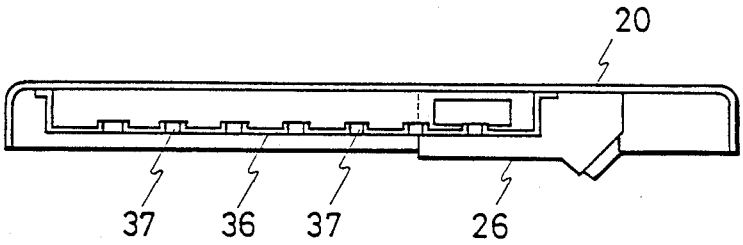
FIGS. 6 and 7 are schematic views showing modified versions of the embodiment.

Referring to FIG. 6, a modified version of the embodiment will be described:

The structure of the tray-like body 20 and the suction duct 26 are respectively the same as those of the first embodiment described above. The modified version has a flat suction case 36 rather than the pyramid-shape of the suction case 23. The pores 37 are provided in the flat bottom of the suction case 36. This modified version has no extra film passageways 21, 22 but it is possible to add such passageways when needed. The device 19 is placed over the main body 11 such that the pores 37 are situated above the developing tank 12 and the fixing tank 13. The fumes are drawn into the outlet duct 26 and discharged out of the system.

While the blower is not operating, the flat bottom of the suction case 36 allows droplets to fall into the developing tank. However the amount of such droplets is negligible compared to the capacity of the tank, and actually no substantial damage occurs to the developer in the tank. In any event, any damage can be remedied by adding a fresh developer. Those droplets which do accumulate will not overflow the peripheral flanges of the pores 37.

Figure 7:
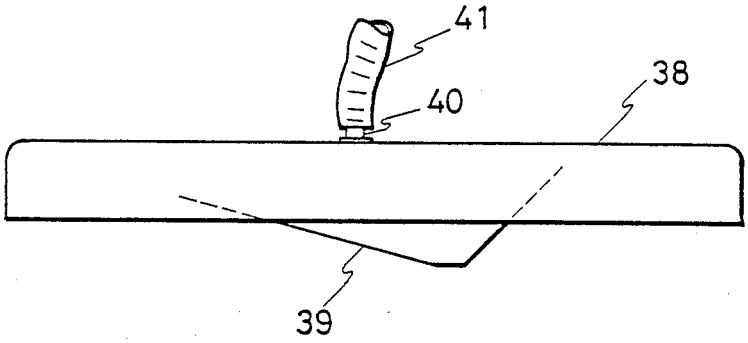
Figure 8:
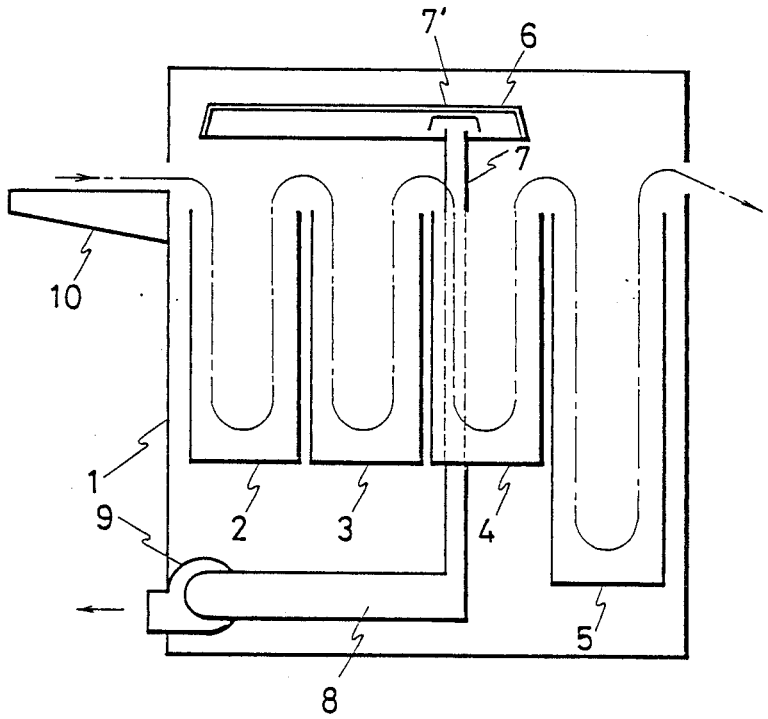
Fig. 8 Prior Art
FIG. 8 is a schematic cross-sectional side view showing a prior art device.

FIG. 7 shows a further modified version, characterized in that it has a suction case 38 connected to the blower 35 through an outlet duct 40. The reference numeral 41 is a flexible hose. The suction case 38 can be the same as the suction case 23 or 36. The third version is more economical than the two versions described above because of its simplified structure.

As is evident from the foregoing description, the invention provides the following advantages:

(1) Since the suction case is situated above the developing tank and the fixing tank where highly concentrated fumes are given off, the fumes are safely collected.

(2) The fumes are collected from throughout the system.

(3) The mechanical components in the system are protected against corrosion by detrimental fumes emitting from the developer and the fixing solution, thereby prolonging the life of the system.

What is claimed is:

1. Apparatus comprising:

a housing defining a developing chamber;

developing and fixing tanks located in said developing chamber such that fumes will be emitted into said chamber when developing and fixing solutions are located in said tanks;

a suction case located in said developing chamber at a location above said developing and fixing tanks, said suction case having pores formed therein which face said developing and fixing tanks;

means for reducing the pressure within said suction case so as to cause said fumes located in said developing chamber to pass through said pores and into said suction case; and means for removing said fumes from said suction case to a location outside of said suction case.

2. Apparatus according to claim 1, wherein said suction case has a bottom portion facing said developing and fixing tanks, said pores being formed in said bottom portion, said bottom portion having a generally inverted pyramid shape, the apex of which lies over said fixing tank.

3. Apparatus according to claim 2, wherein a drain is formed at said apex of said pyramid shaped bottom so as to permit condensed fumes formed inside of said suction case to fall back into said fixing chamber.

4. Apparatus according to claim 3, further including flanges formed along the periphery of each of said pores and extending into the interior of said suction case so as to prevent liquified fumes formed in said suction case from falling through said pores.

5. Apparatus according to claim 1, wherein said pressure reducing means comprises an electric blower.

6. Apparatus according to claim 1, wherein said housing includes a main body portion and a removable cover located at the top of said main body portion and wherein said suction case is coupled to said removable cover.

7. Apparatus according to claim 6, wherein said means for removing said fumes from said suction case includes an exhaust duct coupled to and movable with said suction case and an exhaust piping permanently located in said main body portion, said exhaust duct and exhaust piping being interconnected when said cover is placed over said main body portion.

8. Apparatus according to claim 1, further including flanges formed along the peripheries of said pores and extending into the interior of said suction case so as to prevent liquified fumes formed within said suction case from falling through said pores.

* * * * *